US011001791B2

(12) United States Patent
Sheptunov et al.

(10) Patent No.: US 11,001,791 B2
(45) **Date of Patent: *May 11, 2021**

(54) SOLUTION FOR REMOVING VARIOUS TYPES OF DEPOSITS

(71) Applicant: ANGARA INDUSTRIES LTD., London (GB)

(72) Inventors: Alexandr Alexandrovich Sheptunov, Sochi (RU); Daniil Romanovich Bazanov, Samara (RU)

(73) Assignee: ANGARA INDUSTRIES LTD., London (GB)

( * ) Notice: Subject to any disclaimer, the term of this patent is extended or adjusted under 35 U.S.C. 154(b) by 32 days.

This patent is subject to a terminal disclaimer.

(21) Appl. No.: 16/093,590

(22) PCT Filed: Feb. 14, 2017

(86) PCT No.: PCT/RU2017/050005

§ 371 (c)(1),
(2) Date: Oct. 12, 2018

(87) PCT Pub. No.: WO2017/180026

PCT Pub. Date: Oct. 19, 2017

(65) Prior Publication Data

US 2020/0347327 A1 Nov. 5, 2020

(30) Foreign Application Priority Data

Apr. 12, 2016 (RU) ..... RU2016114065

(51) Int. Cl.

| | |
|---|---|
| ***C11D 1/00*** | (2006.01) |
| ***C11D 3/20*** | (2006.01) |
| ***C11D 3/34*** | (2006.01) |
| ***C11D 3/36*** | (2006.01) |
| ***C11D 3/39*** | (2006.01) |
| ***B08B 3/04*** | (2006.01) |
| ***B08B 3/08*** | (2006.01) |
| ***C23G 1/00*** | (2006.01) |
| ***C23G 1/02*** | (2006.01) |
| ***C11D 11/00*** | (2006.01) |
| ***C11D 3/33*** | (2006.01) |

(52) U.S. Cl.

CPC ..... *C11D 11/0029* (2013.01); *C11D 3/2065* (2013.01); *C11D 3/33* (2013.01); *C11D 3/361* (2013.01); *C11D 3/3947* (2013.01); *C11D 11/0041* (2013.01)

(58) Field of Classification Search

CPC ..... C11D 1/00; C11D 3/1226; C11D 3/20; C11D 3/2075; C11D 3/2086; C11D 3/2096; C11D 3/34; C11D 3/3418; C11D 3/36; C11D 3/39; C11D 3/3942; B08B 3/04; B08B 3/08; C23G 1/00; C23G 1/02; C23G 1/063; C23G 1/065; C23G 1/066

See application file for complete search history.

(56) References Cited

U.S. PATENT DOCUMENTS

| | | | |
|---|---|---|---|
| 2004/0101461 A1 | 5/2004 | Lovetro et al. | |
| 2005/0159323 A1 | 7/2005 | De Waele et al. | |

FOREIGN PATENT DOCUMENTS

| | | | | |
|---|---|---|---|---|
| EP | 0277781 A1 | | 8/1988 | |
| RU | 2011948 C1 | | 4/1994 | |
| RU | 2360415 C1 | | 7/2009 | |
| WO | WO 2019/132735 | * | 7/2019 | ..... C23G 1/00 |

* cited by examiner

*Primary Examiner* — Brian P Mruk

(74) *Attorney, Agent, or Firm* — Morgan, Lewis & Bockius LLP

(57) ABSTRACT

The invention relates to cleaning deposits of various natures from metal, glass and ceramic surfaces of industrial equipment and can be used for the removal of such deposits, as metal oxides (iron, chromium, nickel, etc.), carbonate and salt deposits, asphalt-tar-paraffin deposits and deposits of an oily nature, deposits of organic and biological nature (bacterial deposits). The proposed solution for removing deposits of different natures comprises hydrogen peroxide, complexing agent, calixarene and water in the following quantitative ratio, wt. %: hydrogen peroxide, 2-90; complexing agent, 3-30; calixarene, 0.01-10; water, the balance. EFFECT: increased degree of cleaning off deposits of various natures with simultaneous reduction of solution aggressiveness to structural materials.

20 Claims, No Drawings

SOLUTION FOR REMOVING VARIOUS TYPES OF DEPOSITS

CROSS-REFERENCE TO RELATED APPLICATIONS

This application is a National Stage Entry of International Patent Application No. PCT/RU2017/050005, filed on Feb. 14, 2017, which claims the benefit of priority from Russian Federation Patent Application No. 2016114065, filed on Apr. 12, 2016, the contents of each of which are hereby incorporated by reference in their entirety.

FIELD OF THE INVENTION

The invention relates to cleaning deposits of various natures from metal, glass and ceramic surfaces of industrial equipment and can be used for the removal of such deposits, as metal oxides (iron, chromium, nickel, etc.), carbonate and salt deposits, asphalt-tar-paraffin deposits and deposits of an oily nature, deposits of organic and biological nature (bacterial deposits).

BACKGROUND OF THE INVENTION

There is a known method of liquid chemical purification LCP [application no. 0277781, PHELPS DODGE IND INC. (US), publ, Oct. 8, 1988, C23G1/10], which consists of the following: for the cleaning process, a washing solution containing $H_2SO_4$ ϰ $H_2O_2$ is used, followed by rinsing and drying. With this method, the washing solution and metal to be cleaned are kept in heated state and the duration of the treatment is controlled.

This method is effectively used to remove the scale formed by the high temperature thermomechanical treatment of copper rods. The disadvantages of this method are the use of hot solutions, heating of the sample to be cleaned and instability of oxidizing time of hot detergent solutions.

The method is not versatile and is applicable only for the cleaning of copper rod surfaces. There is a known method of LCP [description of the invention to the application 94-021419/02 "method of cleaning copper surface"], which consists of a washing solution containing 45-75 g/1 of persulfuric acid obtained by the electrochemical treatment of an aqueous 25-50% solution of sulfuric acid.

The treatment is carried out after heating the solution up to 100-120° C. for 3-7 min. The LCP process washing solution is followed by rinsing the products in water and drying them.

This method has several significant disadvantages: it requires the artificial heating of detergent solutions, which results in intensification of their aggressiveness and toxicity. It also has an unstable oxidation capacity and, as a consequence, a non-stable flow of the action process of the cleaning solutions on the surface to be treated. In addition, this method is associated with considerable expenses for neutralization and utilization of industrial wastes.

There is a known method of using peroxides with complexing compounds in disinfecting Compositions [RU 2 360 415 C1, JSC «NPP «Biohimmash» (RU), publ. Oct. 7, 2009, MPK A01N25/22], characterized in that hydrogen peroxide immobilized on a complexing agent is used for the treatment of surfaces for disinfection. 1.5 kg of mechanically activated complexing agent is mixed with 5 kg of peroxide and diluted by adding 301 of water with the addition of surfactant. The disadvantage of this method is the narrow specificity of application: its use only in disinfecting, the absence of inhibitors of metal oxidation and the complexity of surface treatment. The closest in technical essence to the claimed invention is the method [U.S. Pat. No. 4,636,282, GREAT LAKES CHEMICAL CORP (US), publ. 13 Jan. 1987, IPC C23F1/18], consisting of a cleaning process washing solution containing 8-12 wt. %. $H_2SO_4$, 0.004-0.02 M in which stabilizing additive and 0.5 M H2O2 is used. Cleaning in this solution is carried out at 50° C., after which the products are rinsed with water and dried. The advantage of this method is the efficient removal of impurities soluble in acids from the surface, i.e. obtaining a shiny surface.

The disadvantages of this method are its non-universality (applicable only for copper etching), the use of hot solutions and special etching solutions with stabilizing additions.

US2004101461 (A1) discloses an aqueous solution containing hydrogen peroxide in an amount of 20-70 wt. %, a phosphonic acid based complexing agent in an amount of 10-60% (based on the amount of hydrogen peroxide) and water. The solution has a wide application and can be used for bleaching, cleaning, disinfecting, sterilization and oxidation, in particular for use in soil saturation with oxygen (suggested). This cleaning solution is chosen as a prototype.

The disadvantages of the prototype are insufficient efficacy of the solution when used for cleaning metal surfaces, in particular, an inability to remove metal oxides.

DISCLOSURE OF INVENTION

The general purpose of the group of inventions is the creation of a new composition for the efficient removal of deposits of different natures from different surfaces of equipment and products, in particular, metal and/or non-metallic surfaces, for example, glass, ceramic and polymeric surfaces. The general technical result of the group of inventions is the increase of the efficiency of the solution action (degree of purification) for cleaning deposits of various natures with simultaneous reduction of solution aggressiveness to materials of equipment and articles (structural materials). A further technical result in the case of cleaning metal surfaces is the formation of a highly corrosion-resistant layer on the surface of articles to be cleaned of metals and their alloys. The given task and the required technical result are achieved by means of a solution for removing deposits of various natures, which contains hydrogen peroxide, complexing agent, calixarene and water at the following quantitative ratio, wt. %: hydrogen peroxide, 2-90; complexing agent, 3-30; calixarene, 0.01-10; water, the balance. Water-soluble chelating agents are used as complexing agents, for example, polybasic organic acids, their sodium salts and derivatives of phosphorous acids.

In one alternative embodiment of the invention, the solution according to the invention further comprises an organic acid in an amount of 3 to 30% by weight, where acetic acid is used as organic acid as well as formic acid, propanoic acid, butanoic acid, oxalic acid, citric acid, sulfamic acid, adipic, tartaric, lactic, anhydrides of said acids or any possible combination thereof.

In yet another alternative embodiment of the invention, the inventive solution further comprises a peroxide compound decomposition stabilizer in an amount of 1-5 wt. % wherein sodium hexametaphosphate, potassium phosphate, sodium hydrogen phosphate and sodium dihydrogen phosphate are used as the peroxide decomposition stabilizer.

In another alternative embodiment of the invention, the inventive solution further comprises a surfactant in an amount of 0.5-2.5 wt. %., where sulfonol, neonol or their mixture are used as surfactant, preferably in the ratio of 2:1.

In yet another alternative embodiment of the invention, the inventive solution further comprises an inhibitor in an amount of 0.5-1.5 wt. %.

The given task and the required technical result are also achieved due to the concentrated component to obtain the above-mentioned solution, containing complexing agent and calixarene in the following ratio, wt. %: Complexing agent 60-90; calixarene 10-40.

In one alternative embodiment of the invention, the concentrated component according to the invention comprises an inhibitor in an amount of 5-15% by weight.

In yet another alternative embodiment of the invention, the concentrated component of the invention further comprises an organic acid in an amount of 10-85% by weight.

In yet another alternative embodiment of the invention, the concentrated component according to the invention further comprises a peroxide compound decomposition stabilizer in an amount of 10 to 30% by weight.

In yet another alternative embodiment of the invention, the concentrated component of the invention further comprises a surfactant in an amount of from 1 to 10 percent by weight.

The given task and the required technical result are also achieved due to the solution preparation method for cleaning off deposits of different natures, in which the proposed concentrated component is mixed with hydrogen peroxide and diluted with water.

The given task and the required technical result are also achieved due to the method of cleaning the surface by the solution for cleaning from deposits of various natures, including the stage, wherein said surface is brought into contact with the solution according to the invention, said surface being a metal surface or a non-metallic surface.

The given task and the required technical result are also achieved due to the method of cleaning the surface from deposits of different natures, consisting in combining the mechanical, chemical and physico-chemical action on indicated deposits by components of cleaning solution obtained by interaction of concentrated solution, containing at least complexing agent and calixarene, with hydrogen peroxide, followed by dilution with water, resulting in intensive gas formation on surface and inside the pores of said deposits with the formation of bubbles with radius from $1.3\cdot10^{-6}$ m to $2\cdot10^{-3}$ m, which support in the zone of local decomposition temperature up to 150° C. and pressure from 0.1 to 15 MPa, said surface being a metal surface or a non-metallic surface.

The essence of the proposed cleaning technology consists in combination of mechanical and chemical action on deposits, and also combination of complexing and surface-active properties in one molecule of active component (calixarene): one is a complexing agent, the other is a surface-active. The proposed technology uses an exothermic effect of decomposition of peroxide compounds with intensive gas formation on the surface and inside deposits. This effect allows no heating of the cleaning solution, since the decomposition energy is used for these purposes. The use of calixarenes in combination with peroxide compounds also contributes to the absorption reduction of the strength of deposits; this is known as the Rehbinder effect. Intensive gas formation promotes loosening of deposits and desorption from the surface of equipment and articles to be cleaned. In combination with the use of calixarenes that combine in their property both complexing and surface-active properties with the possibility of forming micellar structures, a complete shift of equilibrium towards dissolution of deposits is achieved, in particular, dissolution of metal oxides during the cleaning of metal surfaces.

DETAILED DESCRIPTION OF THE EMBODIMENTS

As stated above, the essence of the proposed technology consists in combining mechanical, chemical and physico-chemical action against deposits, and also the combining of complexing and surface-active properties in one molecule of an active component.

This involves use of peroxide compounds, such as peroxoacids and hydrogen peroxide. The decomposition of these compounds is accompanied by abundant gas generation with energy emission. The radius of the gas bubbles in the peroxide decomposition reaction ranges from $1.3\cdot10^{-6}$ m to $2\cdot10^{-3}$ m. On one hand, the radius must be greater than size of the deposit pores in order for the formation of the bubbles to create a destructive effect on the deposits. On the other hand, increasing the surface tension will not allow the solution to penetrate into the deposit pores, therefore, in each particular case, an intermediate optimal value of the bubble size is selected. Temperature in deposit pores may reach 150° C. and the pressure of gases in the zone of local decomposition may reach values from 0.1 to 15 MPa. The high efficiency of this process is manifested in the deposit pores when a substantial amount of gaseous products are released in a small volume of space. The volume of released gas is proportional to the concentration of hydrogen peroxide.

Thus, the deposits are subjected to mechanical action, which in combination with a low surface tension at the interface of the phases makes it possible to observe the Rehbinder effect. In addition, the effect of exothermic decomposition causes the solution to be heated, which results in an increase in the rate of manifestation of the effects and the flow of chemical reactions directly in the deposit pores.

The cleaning composition contains hydrogen peroxide, complexing agent, calixarene and water. Hydrogen peroxide in amount of 2-90 wt. % (depending on the concentration of the initial solution) provides the processes of gas formation by exothermic decomposition, which in turn has a destructive effect on deposits. The use of a composition with a percentage of less than 2% does not provide the necessary effect (incomplete cleaning). The use of a composition with a percentage content of more than 90% is not recommended, since in this case the effect of intense decomposition may have a destructive effect on the equipment. The concentration of hydrogen peroxide affects the volume of gas and the temperature in the deposit pores. By changing the concentration of the peroxide component, a given intensity of gas formation is obtained.

The complexing agent is used in an amount of 3-30 wt. %. As complexing agents, it is possible to use water-soluble chelating agents, for example, the sodium salts of the polybasic organic acids or the polybasic organic acids themselves, such as EDTA, as well as derivatives of phosphorous acids, such as, NTMP and HEDP. The use of chelating agent in a concentration of less than 3% does not provide the necessary effect of complex formation, and at a concentration of more than 30%, the chelating agent does not dissolve fully.

Water-soluble calixarene of the general formula is used in an amount of 0.1-10%. Preferably, calixarenes of the general formula are used:

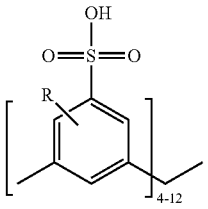

The use of calixarenes of the indicated structure makes it possible to efficiently bind ions of heavy elements, including radioactive ones, forming strong complexes with them. It is possible to use any structures of the above composition. For metal surfaces, compounds with the number of monomer units 6 or 8 are preferred, as in this case the internal cavity of the molecule corresponds to the radius of the heavy elements. The use of calixarenes in less than 0.01% concentration does not provide a complexing effect. If the concentration is increased (more than 10%), no improvement of the cleaning properties is observed.

The use of water-soluble derivatives of calixarenes that combine in their property complexing and surface-active properties, makes it possible to considerably increase efficiency of cleaning. In particular, in the case of metal surfaces, the metal ions are bound and transferred to the micellar phase (early not proposed).

Organic acid can be additionally introduced in an amount of 3-30 wt. %, for example acetic acid, formic acid, propanoic acid, butanoic acid, oxalic acid, citric acid, sulfamic acid, adipic acid, tartaric acid, lactic acid, anhydrides of said acids, or any possible combination thereof.

The use of organic acids further increases the efficiency of the decomposition of hydrogen peroxide by the formation of peroxoacids. This range of concentrations provides a maximum effect. Using a lack or excess of reactants, the pH level of the medium will not promote the complexation and the controlled decomposition of the peroxide compounds.

Additional mechanical action on deposits is achieved by the decomposition of peroxide compounds of a number of carboxylic acids C1-C6, and also dicarboxylic C2-C6, tricarboxylic, tetracarboxylic acids. For example, the use of monocarboxylic acids such as acetic acid and formic acid is the most optimal for further increasing the efficiency of carbonate scale purification. For the purpose of producing stable complexes with iron ions, the use of dicarboxylic acids is especially optimal, such as oxalic and adipic, or tricarboxylic acids, eg citric acid. The use of tetracarboxylic acid EDTA and/or its salts is most optimal as a universal complexing agent. These examples of specific acids are provided for the purpose of illustrating the embodiment of the group of the invention and are not intended to limit the scope of the invention. These examples of acids should not be construed as limiting the scope of the claimed group of inventions, which is defined by the claims. All carboxylic acids used in this technology are biodegradable.

A decomposition stabilizer of peroxide compounds can be additionally introduced in the composition in amount of 1-5%, for example, sodium hexametaphosphate or similar phosphoric acid salts, such as potassium phosphate, sodium hydrogen phosphate, sodium dihydrogen phosphate. When a stabilizer is used in a concentration of less than 1%, the degradation occurs in an avalanche and is not controlled, while more than 5% does not provide adequate gas generation. The rate of gas generation during the decomposition of the peroxide compounds is mainly dependent on the concentration of the decomposition stabilizer.

Additionally, a surfactant may be added in an amount of 0.5-2.5%. The surfactant used is, for example, sulfonol together with neonol in the ratio of 2:1, but it is possible to use these substances as independent components of the surfactant. The use of the surfactant makes it possible to further increase the efficiency of the solution purification by reducing the surface tension at the liquid-solid interface (cleaning solution-deposit). This effect is due to the absorption of surfactant Molecules on the deposit surface and is due to the similarity of chemical nature in the molecules of the deposits and surfactant. Reduction of surface tension causes better wettability of deposits by cleaning composition, which implies an increase of contact area between the solution and deposits. In addition, the above effect allows the solution to penetrate into the deposit pores, which results in the possibility of delivering peroxide compounds into deposit pores with subsequent decomposition. The selection of a surfactant is an important task and is individually solved depending on the nature of the deposits. Among general cases, it may be noted that anionic surfactants such as alkylbenzenesulfonic acids can be used in oil purification processes; cationic surfactants, such as cetrimonium chloride, can be used for removing deposits of silicate nature. The choice of surfactants is also due to the pH level of the solution, since the use of anionic surfactants is not suitable in an acidic medium, just as cationic surfactants are not suitable in an alkaline medium. The use of a surfactant in concentrations below 0.5% does not provide a wetting effect. Surfactant concentrations more than 2.5% do not affect further improvement of cleaning efficiency. In addition, the surfactant makes it easier to achieve the desired bubble sizes.

In order to eliminate the destructive effect of the cleaning composition directly on metal, glass and ceramic surfaces of equipment, appropriate inhibitors are additionally used in an amount of 0.5-1.5%. These substances form an insoluble strong layer on the surface, which protects the surface against the action of the solution's active components. The use of an inhibitor in less than 0.5% of the concentrations does not provide the proper inhibitory effect, and at a concentration of more than 1.5% does not lead to an increase in the inhibition efficiency. As an inhibitor for metal surfaces, for example, inhibitor KI-1 is used, for alloyed and carbon steels—Catapine-B, for ferrous and non-ferrous metals—KI-1. In particular, inhibitors of metal dissolution prevent oxidative action of peroxide compounds and create an oxidation-resistant protective film.

The washing action is achieved by pumping the cleaning composition through the equipment contours, or by placing the parts in a circulating bath.

Example samples (see table 1) were prepared to confirm the quantitative content of reagents in an aqueous solution for cleaning deposits from metallic and non-metallic surfaces. These examples passed the test for the evaluation of purification efficiency.

TABLE 1

Examples (samples) of cleaning solutions.

| Composition, wt. % | Examples 1 | 2 | 3 | 4 | 5 | 6 | 7 | 8 | 9 | 10 |
|---|---|---|---|---|---|---|---|---|---|---|
| Hydrogen peroxide | 2 | 25 | 90 | 5 | 15 | 30 | 5 | 15 | 60 | 90 |
| Complexing agent | 4 | 4 | 6 | 4 | 4 | 6 | 15 | 30 | 5 | 10 |
| Stabilizer of decomposition of peroxides | 0 | 0 | 0 | 2 | 3 | 4 | 2 | 2 | 8 | 10 |
| Surfactant | 0 | 0 | 0 | 1 | 1 | 2 | 2 | 2 | 2 | 2 |
| Calixarene | 15 | 2 | 0.01 | 10 | 0.1 | 0.1 | 15 | 0.1 | 0.1 | 0.1 |
| Water | balance | balance | balance | balance | balance | balance | balance | balance | balance | balance |

To prepare a solution (sample) of example 1, a concentrated component containing a complexing agent (EDTA) and water-soluble calixarene (6 monomer units) were mixed with a hydrogen peroxide solution of 36% and diluted with water. The resulting cleaning solution had the following composition: hydrogen peroxide (5%), EDTA (4%), water-soluble calixarene (10%), and water (the balance). The resulting solution was pumped through heat exchange equipment contaminated with carbonate deposits and iron oxides. Purity control was carried out by visual method and by the method of differential pressure at the inlet and outlet of the heat exchanger. The results of the efficiency evaluation are shown in Table 2.

TABLE 2

Results of the cleaning efficiency evaluation of solutions samples.

| Cleaning characteristics | Examples 1 | 2 | 3 | 4 | 5 | 6 | 7 | 8 | 9 | 10 |
|---|---|---|---|---|---|---|---|---|---|---|
| Presence of deposits after cleaning, % to the area | 10 | 0 | 0 | 0 | 0 | 0 | 15 | 0 | 0 | 0 |
| Time of cleaning, hours | 8 | 8 | 8 | 8 | 8 | 8 | 8 | 8 | 8 | 8 |
| Aggressive action of the solution on metal | Partial destruction | absent | absent | absent | absent | absent | Partial destruction | absent | absent | absent |

The solutions of examples 1 and 10 were prepared in the same manner as in example 1, with the following exceptions:

As a complexing agent according to example 2, NTMP was used, according to example 3—EDTA, according to example 4—EDTA, according to example 5—NTMP, according to example 6—HEDP, according to example 7—EDTA, according to example 8—EDTA, according to example 9—HEDP, according to example 10—NTMP; sodium polyphosphate was used as the peroxide decomposition stabilizer in examples 4-10; as the surfactant in example 4, sulfonol was used, in example 5—OP-7, in example 6—sulfonol, in example 7—OP-10, in example 8—OP-7, in example 9—sulfonol, in example 10—OP-10.

The solutions obtained according to examples 2-10 were tested and evaluated in the same manner as in example 1. These tests confirm the increase in efficiency of the inventive solution for removing deposits of various natures while reducing the aggressiveness of the solution to the structural materials.

While the present group of inventions has been described in detail in the examples of embodiments which are the preferred ones, it should be remembered that these embodiments are provided only for the purpose of illustrating the invention. This description is not to be construed as limiting the scope of the invention, since changes in the solution described, in a concentrated component for its preparation, in the method of preparation of the solution and in the method of purification by those skilled in the field of chemistry and others may be made, which are directed to adapt them to specific compositions of solution or situations and do not go beyond the scope of the following claims of the group of inventions. One skilled in the art will recognize that within the scope of the invention, which is defined by the claims, multiple variations and modifications are possible, including equivalent solutions.

The invention claimed is:

1. A solution for cleaning a surface of deposits of different natures, comprising:

hydrogen peroxide, 2-90 wt. %;

complexing agent, 3-30 wt. %;

water-soluble calixarene, 0.01-10 wt. %; and water;

the complexing agent comprising a polybasic organic acid or a sodium salt thereof, or a derivative of phosphorous acid.

2. The solution according to claim 1, further comprising an organic acid in an amount of 3-30 wt. %.

3. The solution according to claim 1, further comprising a decomposition stabilizer of peroxide compounds in an amount of 1-5 wt. %.

4. The solution according to claim 1, further comprising a surfactant in an amount of 0.5-2.5 wt. %.

5. The solution according to claim 1, further comprising an inhibitor in an amount of 0.5-1.5 wt. %.

6. The solution according to claim 2, wherein the organic acid comprises acetic acid, formic acid, propanoic acid, butanoic acid, oxalic acid, citric acid, sulfamic acid, adipic acid, tartaric acid, acid anhydrides, or any combination thereof.

7. The solution according to claim 1, wherein the complexing agent further comprises a water-soluble chelating agent.

8. The solution according to claim 3, wherein the decomposition stabilizer of peroxide compounds comprises one or more of sodium hexametaphosphate, potassium phosphate, sodium hydrogen phosphate and sodium dihydrogen phosphate.

9. The solution according to claim 4, further comprising sulfenic acid, a nonylphenol ethoxylate, or their mixture as a surfactant.

10. The solution according to claim 8, further comprising a mixture of sulfenic acid with a nonylphenol ethoxylate in the ratio of 2:1.

11. A concentrated component for preparation of a solution for cleaning a surface of deposits of different natures, comprising a complexing agent and a water-soluble calixarene in the following ratio, wt. %:

complexing agent 60-90; and water-soluble calixarene 10-40;

the complexing agent comprising a polybasic organic acid or a sodium salt thereof, or a derivative of phosphorous acid.

12. The concentrated component according to claim 11, further comprising an inhibitor in an amount of 5-15% by weight.

13. The concentrated component according to claim 11, further comprising an organic acid in an amount of 10-85 wt %.

14. The concentrated component according to claim 11, further comprising a decomposition stabilizer of peroxide compounds in an amount of 10-30 wt. %.

15. The concentrated component according to claim 11, further comprising a surfactant in an amount of 1-10% by weight.

16. A method of preparing a solution for cleaning a surface of deposits of various natures comprising a hydrogen peroxide, 2-90 wt. %; a complexing agent, 3-30 wt. %; a water-soluble calixarene, 0.01-10 wt. %; and water; wherein the complexing agent comprises a polybasic organic acid or a sodium salt thereof, or a derivative of phosphorous acid; comprising mixing said solution.

17. A method of cleaning surfaces of deposits of various natures, where the surface to be cleaned is brought into contact with a solution of claim 1.

18. The method of cleaning according to claim 17, wherein said surface is a metal surface or a non-metallic surface.

19. A method of cleaning surfaces of deposits of various natures consisting of:

combining mechanical, chemical and physico-chemical action on indicated deposits by components of cleaning solution obtained by interaction of concentrated solution, containing at least complexing agent and calixarene, with hydrogen peroxide, followed by dilution with water, resulting in intensive gas formation on the surface and inside the pores of said deposits with the formation of bubbles with radius from $1.3 \cdot 10^{-6}$ m to $2 \cdot 10^{-3}$ m, which support in a zone of local decomposition temperature of up to 150° C. and pressure from 0.1 to 15 MPa.

20. The method according to claim 19, wherein said surface is a metal surface or a non-metallic surface.

* * * * *